US005673502A

United States Patent [19]

Caterbone

[11] Patent Number: 5,673,502

[45] Date of Patent: Oct. 7, 1997

[54] HEADLAMP FOR SPORTS SHOES, PARTICULARLY FOR INLINE SKATES AND THE LIKE

[76] Inventor: Michael Thomas Caterbone, 5472 Fox Hollow Dr., Boca Raton, Fla. 33486

[21] Appl. No.: 505,686

[22] Filed: Jul. 21, 1995

[51] Int. Cl.[6] ..... A43B 23/00

[52] U.S. Cl. ..... 36/137; 36/77 R; 36/136; 362/103

[58] Field of Search ..... 36/137, 136, 132, 36/77 R, 72 R; 362/103, 190, 191

[56] References Cited

U.S. PATENT DOCUMENTS

| | | | |
|---|---|---|---|
| 2,268,435 | 12/1941 | Zucker | 36/72 R |
| 2,435,689 | 2/1948 | McCabe | 362/203 |
| 2,572,760 | 10/1951 | Rikelman | 362/103 |
| 2,671,847 | 3/1954 | Lerch | 36/137 |
| 3,008,038 | 11/1961 | Dickens et al. | 36/137 |
| 3,067,322 | 12/1962 | Sala | 36/137 |
| 3,241,153 | 3/1966 | Brewer | 36/72 R |
| 3,501,144 | 3/1970 | Schmidt | 36/139 |
| 4,240,132 | 12/1980 | Wickman | 362/103 |
| 4,422,131 | 12/1983 | Clanton | 362/103 |
| 4,455,764 | 6/1984 | Rock et al. | 36/136 |
| 4,463,412 | 7/1984 | Broach | 362/61 |
| 4,819,139 | 4/1989 | Thomas | 362/191 |
| 5,033,212 | 7/1991 | Evanyk | 36/137 |
| 5,149,489 | 9/1992 | Crews | 362/32 |
| 5,303,131 | 4/1994 | Wu | 362/103 |
| 5,327,329 | 7/1994 | Stiles | 362/61 |
| 5,329,432 | 7/1994 | Bland | 362/103 |

*Primary Examiner*—M. D. Patterson
*Attorney, Agent, or Firm*—William J. Dick

[57] ABSTRACT

A light apparatus adapter for attachment to a sports shoe. The apparatus includes a toe shoe form (10) adapted for substantial circumlocution of the upper portion of a toe of a shoe intended for sport use, e.g. skating, hiking, walking etc. The toe shoe form (10) is comprised of a relatively hard, but somewhat flexible plastic shell dimensioned for spaced apart, overlapping and superimposed relation with respect to the upper toe portion of a shoe. At least along the interior marginal and laterally extending edges (14) of the toe shoe form is attached resilient and compressible polyeurathane foam, the interior width ("w") of the opening intermediate or between the interior lateral edges with the resilient and compressible polyeurathane foam in place being less than the width of the toe of the shoe for which the toe shoe form (10) is intended to thereby compress the foam against the toe of the shoe, when in place, inhibiting displacement of the toe shoe form. For applying a rearwardly directed force to the toe shoe form (10) to further inhibit movement of the toe shoe form off of the shoe of the wearer, a strap (50) is connected to the toe shoe form for circumscribing the heal of the shoe to which the toe shoe form is to be attached. A light (40) is connected to the toe shoe form, for focusing a light in generally a direction forward of the toe shoe form (10) to light the path ahead of the shoe wearer.

5 Claims, 4 Drawing Sheets

HEADLAMP FOR SPORTS SHOES, PARTICULARLY FOR INLINE SKATES AND THE LIKE

FIELD OF THE INVENTION

The present invention relates to a shoe light attachment for sports shoes and more particularly relates to a shoe light particularly adapted for skating at night or in poor light conditions to light the pathway for a skater.

BACKGROUND OF THE INVENTION AND DESCRIPTION OF RELATED ART

In the past two decades, the importance of physical fitness for persons of all ages has come under increased scrutiny with a concomitant increase in special equipment for users who can only exercise in off work hours. Moreover, with an increase in the number of retired persons in the sun belt areas of the country, many times the only comfortable time of the day for outside exercise is during the evening hours when light conditions are poor. Anyone who lives or has lived in urban areas will attest to the increase in the number of walkers, speed walkers, joggers and especially in line roller skaters that are in evidence.

Skating of all types has enjoyed a rebirth in interest for people of all walks of life. People who formerly were active ice-skaters or in door or out door roller skaters and have moved to a warmer climate now find that inline roller skating is an excellent way to maintain or increase their exercise and fitness level utilizing much the same physical principles and body muscles that they formerly engaged when they used ice-skating as a principal activity. The problem is that while minor road blemishes may be insignificant to bikers, motorists and the like, such blemishes are to be avoided by the casual skater to prevent harmful injuries due to falls. At night, the safety risk is multiplied. What is required for night use, however, is a focused headlamp or head light like fixture for projecting a light beam far enough, with enough brilliance to permit advance warning and view by the skater to avoid otherwise unavoidable accidents.

There have been numerous attempts to provide for lighted skates and the like. All of these attempts have proved successful with regard to visibility of the skater at night to other persons or animals, but are unsuccessful for increasing the visibility of the pathway of the user the required amount to inhibit otherwise avoidable accidents due to vagaries, blemishes or the like in the pathway surface. For example, U.S. Pat. No. 5,033,212 to Evanyk on Jul. 23, 1991 uses LED's on the shoe; U.S. Pat. No. 5,329,432 to Bland on Jul. 12, 1994 uses the flexible tongue on footwear to fold over and embrace a forwardly directed incandescent lamp, not focused and not reflective; U.S. Pat. No. 2,671,847 to Lerch issued Mar. 9, 1954 illustrates a clip on device for the shoe laces of a boot; U.S. Pat. No. 4,367,515 issued on Jan. 4, 1983 to Beard shows LED's in the toe stop of a roller skate to provide illumination; U.S. Pat. No. 4,240,132 to Wickman issued on Dec. 16, 1980 illustrates a light assembly provided for securement to an existing skate is of a different structure, although the light is for focused illumination; and U.S. Pat. No. 3,501,144 to Schmidt issued on Mar. 17, 1970 illustrates a Toe Toy for heal attachment of the toe form which includes lights and a noise maker.

U.S. Pat. No. 2,572,760 to Rikelman on Oct. 23, 1951 illustrates a toe slip on device with springeable sides for embracing the toe of the shoes and includes a battery holder and ball and lever actuable light with an eye shaped opening for the non focused and non reflective light. Inter alia, there is no resilient, compressible friction means employed to help ensure the attachment of the toe slip on device, nor does the light design appear sufficient to project sufficiently forwardly enough for safe night travel, e.g. on an inline skate.

In U.S. Pat. No. 4,463,412 to Broach on Jul. 31, 1984 discloses an illuminated shoe skate attachment which provides, via bracket attachments to the underside of the skate, and a bubble like translucent or transparent cover adjacent the toe, illumination of the skate by a non-focused and non-reflective light. This a good example of a light being provided more for aid to visibility to others than for increasing the skate's view so as to increase skater safety. Moreover, the necessity of the many brackets and the numerous lights required illustrate the fundamental difference between the device of the present invention and the prior art.

None of the above noted patents, taken either singly or in combination are believed to disclose or teach the specific arrangement taught by the present invention.

SUMMARY OF THE INVENTION

In view of the above, it is a principal object of the present invention to provide an improved, easily attachable illumination device for sports shoes, which device may be employed where additional viewing range of the shoe wearer is desirable for increased safety of the wearer under conditions of poor lighting.

Another object of the present invention is to provide improved apparatus for providing a lit pathway for sports shoe wearers under poor lighting conditions, which requires no skate modification, is easily attachable and detachable to and from the shoe, and which is easily and cheaply manufactured.

These and other objects are met, in the present instance, by providing a light apparatus adapter for attachment to a sports shoe. The apparatus includes a toe shoe form adapted for substantially circumscribing the upper toe portion of the upper portion of a toe of a shoe intended for sport use, e.g. skating, hiking, walking etc. The toe form is comprised of a relatively hard, but somewhat flexible plastic shell dimensioned for spaced apart, overlapping and superimposed relation with respect to the upper toe portion of a shoe. At least along the interior marginal and laterally extending edges of said toe shoe form is attached resilient and compressible frictional means (e.g., foam rubber), the interior width of the opening intermediate or between said interior lateral edges with said resilient and compressible frictional means in place being less than the width of the toe of the shoe for which said toe shoe form is intended to thereby compress the foam rubber against the laterally extending toe portion of the shoe, when in place, inhibiting displacement of the toe shoe form. For additional insurance against displacement of the toe shoe form once in place over the toe of a sport shoe, and to further inhibit movement of said toe shoe form off of the shoe of the wearer, a strap is connected to the toe shoe form for circumscribing the heal of the shoe to which the toe shoe form is to be attached. A focused light is connected to the toe shoe form, for focusing a light in generally a direction forward of said shoe form to light the path ahead of the shoe wearer.

Other objects and a more complete understanding of the invention may be had by referring to the following description taken in conjunction with the accompanying drawings in which:

BRIEF DESCRIPTION OF THE DRAWING(S)

DESCRIPTION OF THE ILLUSTRATIVE EMBODIMENT

Figure 1:
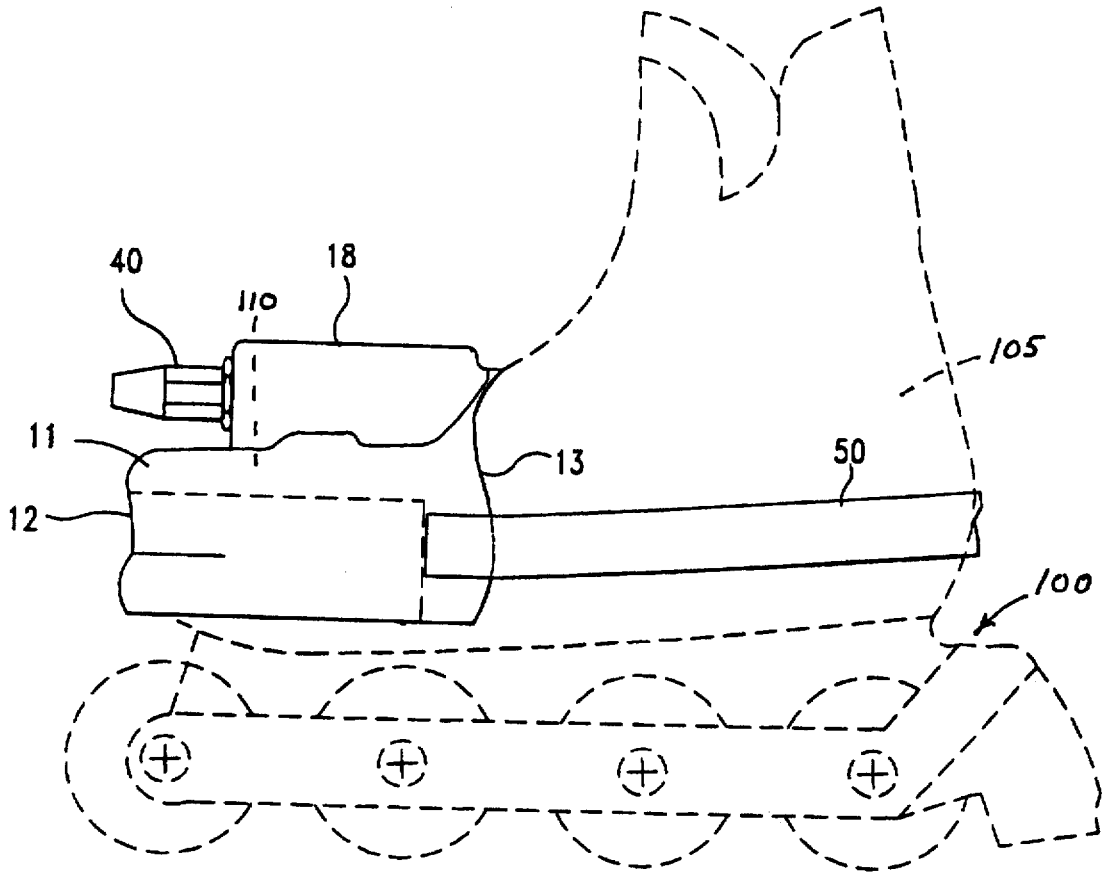
FIG. 1 is a side elevational view of an inline roller skate shown in phantom outline including a toe shoe form, constructed in accordance with the present invention, overlying the sports shoe portion of the inline skate, for embracing the toe portion of the sports shoe.

Turning now to the drawings, and especially FIG. 1 thereof, a toe shoe form 10 constructed in accordance with the present invention, is shown therein. The toe shoe form 10 generally is dimensioned to fit in superimposed, overlapping relation with respect to the toe portion 110 of a sports shoe 105 principally intended for sports activities. In the illustrated instance the sports shoe 105 is of an inline skate 100. These 'sports activities' include, but are not limited to, skating, hiking, exercise walking and the like, and particularly in poorly illuminated areas and or at night.

As illustrated in FIGS. 2–5, the toe shoe form 10 comprises a rigid but thin plastic shell 11 with a closed frontal portion 12 and an open rearward portion 13 forming a generally semi-cylindrical cavity 20 for overlying the toe portion of a sports shoe, e.g. toe portion 105 of shoe 100. The lower terminal edge 14 of the toe shoe form 10 thus appears U-shaped from a bottom view (not shown). At the upper portion 15 of the toe shoe form 10 is a compartment 16 defined by a frontal wall 17 offset from the frontal portion 12 of the toe shoe form 10 and having an outer shell portion 18 which forms part of the shell 11. As illustrated best in FIGS. 2 and 4, the compartment 16 forms a housing or receptacle for a power supply 30 and in conjunction with frontal wall 17 of the compartment 16, acts as a base and support for a focused light source 40.

In accordance with one feature of the invention, frictional means are disposed in such a manner to engage and embrace the sides and partially the curved upper portion of the toe portion 110 of the sports shoe 105 to thereby inhibit disengagement of the toe shoe form 10 from the sports shoe 105. To this end, and referring to FIGS. 4 and 5, resilient and compressible frictional means 21 are disposed and attached to the interior of the cavity 20, at least along the marginal and laterally extending edges **14*a* and 14*b* of the lower marginal edge 14 of the toe shoe form 10. In the illustrated instance, and for ease of assembly, the resilient and flexible means 21 is a single piece of foam material disposed so as to circumscribe the interior portion of the lower marginal edge 14 of the cavity and attached by any convenient means, e.g. glue to the interior wall of the shell 11**. While any convenient compressible but resilient material may be employed, a ½" (thickness=z) by 1 and ½" (height=h) (see FIG. 5) polyurethane tape such as U210 PUFM Tape made by Pak-Lite Inc. of Doraville, Ga. is a good choice of material.

While the cavity 20 should be large enough to embrace in spaced apart relation a range of sport shoe sizes and widths, it is preferable that with the compressible but resilient material 21 in place, the width=w size of the opening defined intermediate the material (see FIG. 5) should be less than the width of the toe of the shoe for which the toe shoe form 10 is intended. In this manner, simply sliding the toe shoe form over the upper toe portion of a sports shoe will effect compression of the material 21. The frictional engagement caused by deformation of the material to conform to the sports shoe toe contour will act to inhibit inadvertent dislodgement of the toe shoe form 10 from the toe of the sports shoe, e.g. the inline skate.

Figure 2:
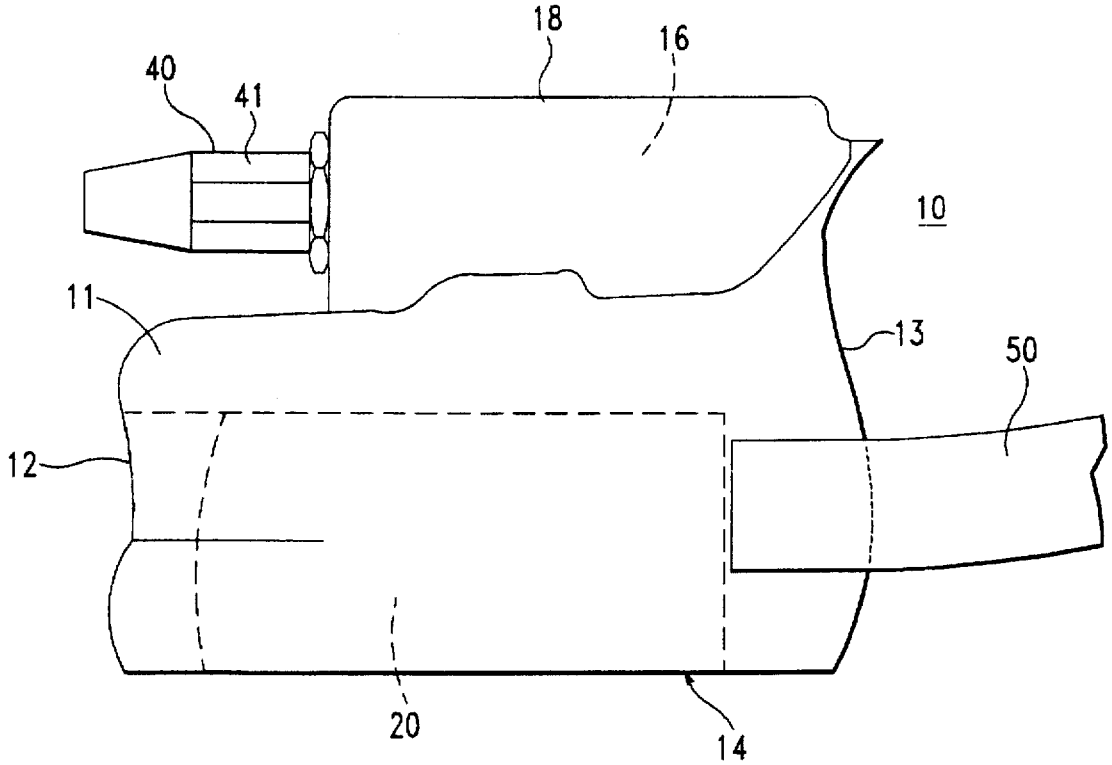
FIG. 2 is an enlarged side elevational view of a toe shoe form as shown in FIG. 1, for a sports shoe, which toe shoe form is constructed in accordance with the present invention.
Figure 3:
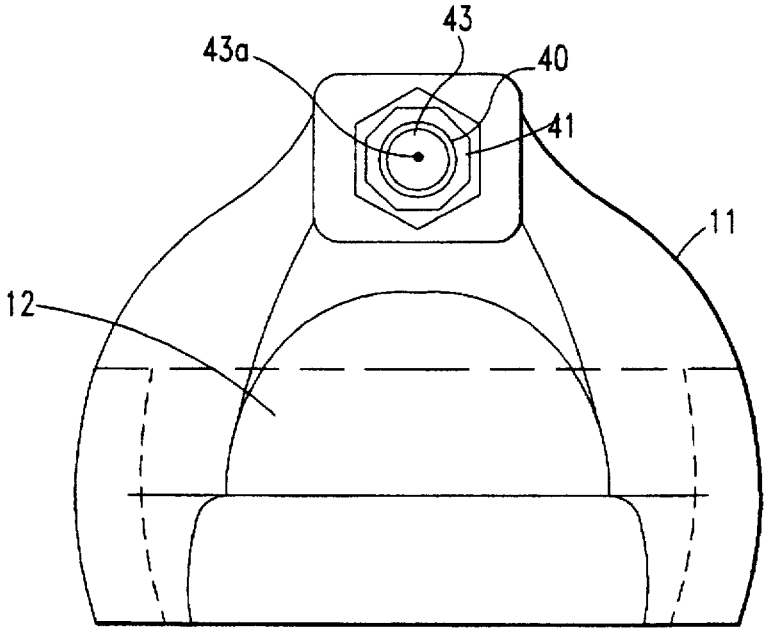
FIG. 3 is a front elevational view of the toe shoe form illustrated in FIG. 1.
Figure 4:
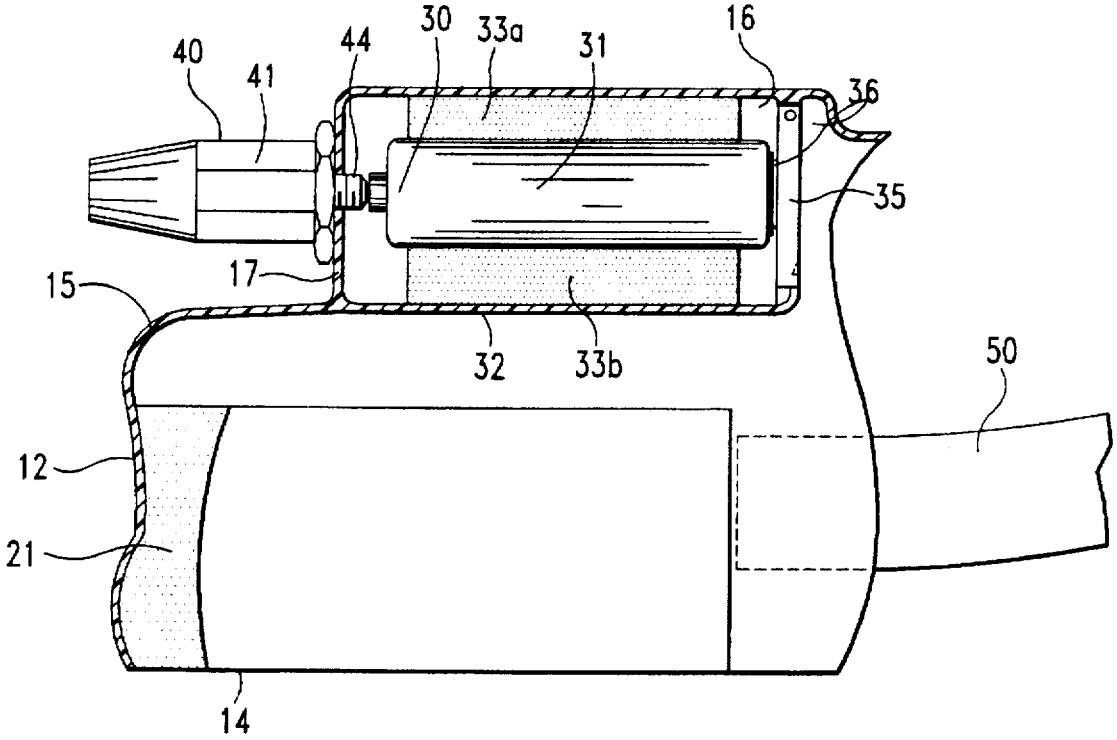
FIG. 4 is a fragmentary side elevational view of a toe shoe form for a sports shoe and showing the interior of the power supply compartment in the toe shoe form.
Figure 5:
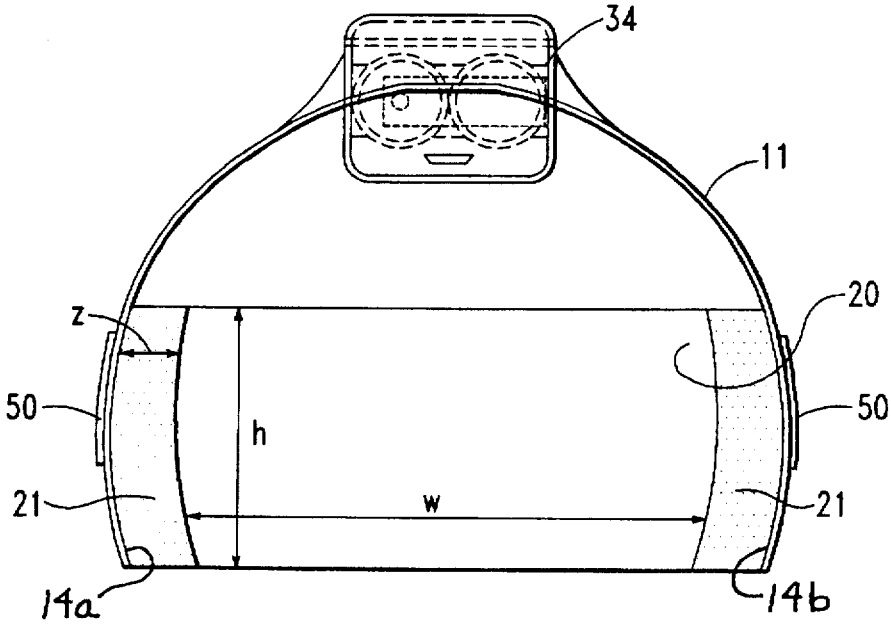
FIG. 5 is rear elevational view of the toe shoe form of FIG. 3.
Figure 6:
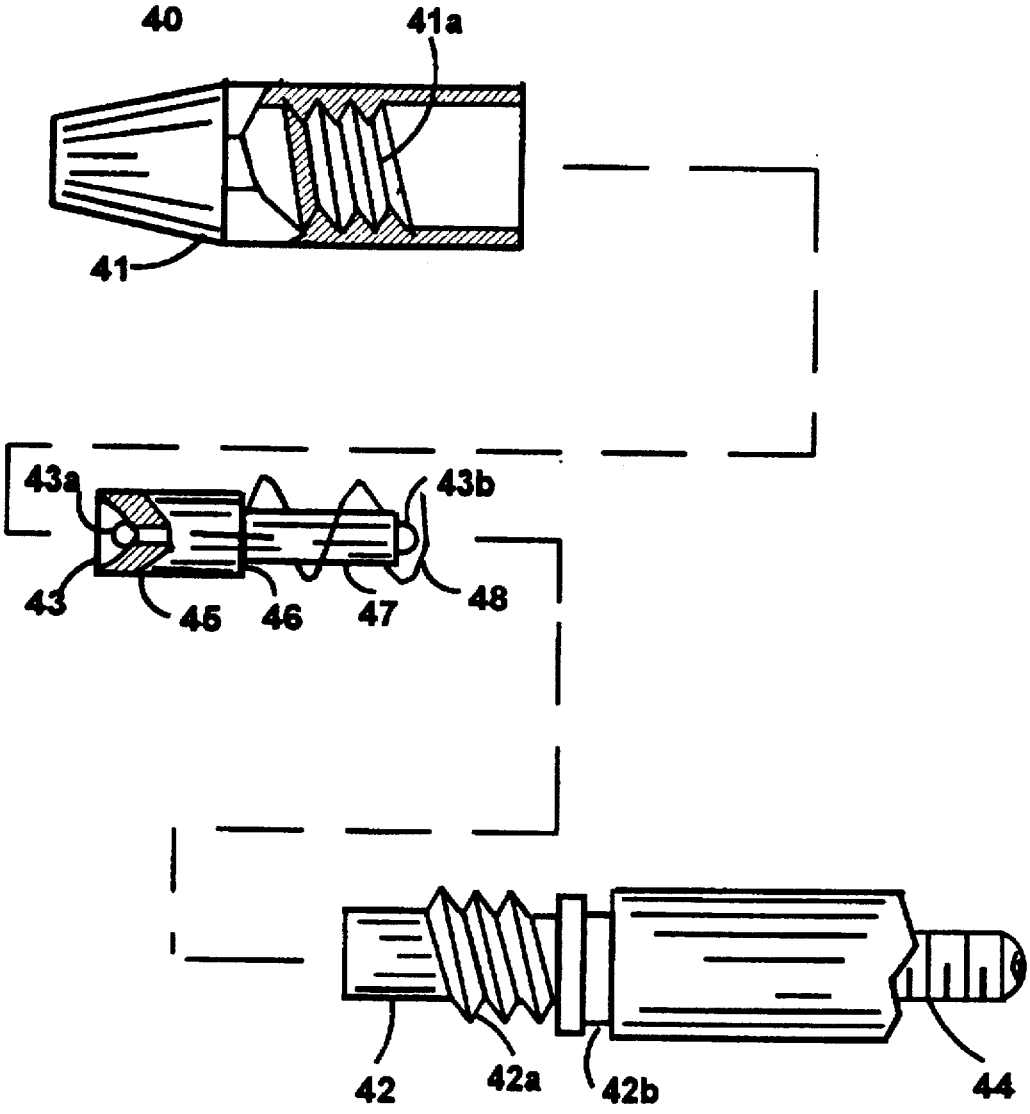
FIG. 6 is an exploded view of a typical focused head lamp or light which may be employed for lighting the pathway of a person wearing the toe shoe form of the present invention, in place on a sports shoe such as the inline skate shown in FIG. 1.

In accordance with another feature of the invention, the focused light source 40 includes a transparent cylindrical barrel 41 which is rotatably mounted onto a bulb holding cylindrical stem or the like 42 in which a biased (spring loaded) reflector and bulb combination 43 is located. (See FIG. 6.) The transparent barrel 41 is preferably internally threaded as at **41*a* to coact with matching external threads 42*a* on the exterior of the cylindrical stem 42 while the stem is rigidly attached to the wall 17 of the compartment or power supply receptacle 16 (FIGS. 2–4). A conductive base portion 44 connects the interior of the stem 42 into the power supply compartment or receptacle 16. The bulb and reflector 43 forms part of a sliding assembly 45. The assembly 45 includes a stepped shoulder 46 and a tail portion 47 which fits interiorly of the stem 42. The assembly 45 is biased outwardly toward the front of the transparent cylinder 41 by a spring 48 which circumscribes the tail portion 47 of the assembly 45, abuts at one end the shoulder 46 on the assembly 45, and on the other end a shoulder 42*b* in the stem 42. In this manner, when the transparent cylinder 41 is rotated following the coacting threads 41*a*, 42*a*, the spring 48 is compressed. As the tail portion 47 of the assembly 45 moves in the stem 42, the base 43*a* of the bulb contacts the conductive base portion 44 completing the power supply circuit with the power supply 30, lighting the bulb. Thus the bulb may be switched on and off by simple rotation of the transparent cylinder 41**.

While other types of focused lights may be employed, the light assemblies made by Pelican Products Inc. Of Torrance California, under the trade name "Mightylamp", mod.#1904 or 1974 are of excellent design for the intended purpose. For example with a pair of AA batteries 31 connected in series as a D.C. power supply, the 1904 "Mightylamp" will put out a focused 4,000 candle power light beam while the model 1974 will put out a 6,000 candle power light beam. The lower powered light will throw a beam of light about 18 to 20 feet, and the higher powered model will cast a similar focused beam of considerably greater distance. Moreover, the aforementioned company sells an excellent light which includes the mounting hardware which is adjustable permitting the light focused source to be adjusted as to the beam direction by the user under special or desired circumstances.

The power supply compartment or battery receptacle 16 may be of conventional variety and include, as illustrated in FIG. 4, a sliding compartment door 32 with a battery holder or cage 34 operative in conjunction with a pair of foam strips **33*a*, 33*b* embracing opposite longitudinal sides of the batteries 31 to hold the batteries in place. The base plate 35 of the compartment 16 may be conductive and include a leaf like spring 36 to press the batteries 31 against the base extension 44. In this manner, power is applied to the base extension 44**, even though not used until the bulb completes the circuit.

To ensure that the toe shoe form remains in place on front of the sport shoe during times of high stress, it is preferable that toe shoe form securing means, in addition to the resilient and compressible frictional means 21, be provided. To this end, a strap 50 is connected to said toe shoe form 10, the strap being positioned so that it circumscribes the heel of the sports shoe so as to apply a rearwardly directed force to the toe shoe form 10 to inhibit movement of the toe shoe form off of the shoe. The strap 50 may be of a single piece of resilient material, i.e., a rubber band or may include two pieces with a connecting fastening means, e.g. a buckle or Velcro etc. However, a single piece resilient strap 50 has been found to be more than adequate for its intended purpose.

Although the invention has been described with a certain degree of particularity, it should be recognized that elements thereof may be altered by person(s) skilled in the art without departing from the spirit and scope of the invention as hereinafter set forth in the following claims.

What is claimed is:

1. A light apparatus for attachment to a shoe primarily intended for sports use, said shoe having a toe including an upper toe portion, and a heel portion, said apparatus comprising:

a semi-cylindrical toe shoe form having a closed frontal portion, an open rearward portion forming a semi-cylindrical cavity, and an open bottom portion for substantially circumscribing and overlying the upper toe portion of said toe of said shoe, said toe form being comprised of a rigid plastic shell dimensioned for overlapping and superimposed relation with respect to said upper toe portion of said shoe, resilient and compressible frictional means at least along the interior marginal and laterally extending edges of the interior of said toe shoe form, the interior width of the opening defined intermediate said interior laterally extending edges of said resilient and compressible frictional means with said means in place being less than the width of the toe of said shoe for which said toe shoe form is intended so that the compressible frictional means is compressed and frictionally engages the toe portion of the shoe, when in place, whereby said frictional means prevents said toe shoe form from sliding upwardly over said upper toe portion;

a light connected to said toe shoe form, for focusing a light in generally a direction forward of said shoe form, and receptacle means interiorly of said toe shoe form for receiving a power supply for said light, and user operable switch means for connecting said light to said power supply, and a strap connected to said toe shoe form for circumscribing the heal portion of said shoe to which said toe shoe form is to be attached and for applying a rearwardly directed force to said toe shoe form to inhibit movement of said toe shoe form off of said shoe of the wearer when said toe shoe form is in place on said shoe.

2. A light apparatus for attachment to a shoe in accordance with claim 1 wherein said strap is composed of a resilient material for attachment of the toe shoe form to a range of shoe sizes.

3. A light apparatus for attachment to a shoe in accordance with claim 1 wherein said strap includes means for making said strap adjustable in length to allow attachment of the toe shoe form to a range of shoe sizes.

4. A light apparatus for attachment to a shoe in accordance with claim 1 wherein said light comprises a transparent cylinder; a light bulb and reflector mounted for movement within a cylindrical stem, and means for effecting and permitting movement of said transparent cylinder against said light bulb and reflector to move it into and out of engagement with said power supply; and biasing means comprising a spring for normally urging said light bulb and reflector out of engagement with said power supply until the urging by said spring is overcome by said means for effecting movement of said transparent cylinder against said light bulb and reflector.

5. A light apparatus for attachment to a shoe in accordance with claim 4 wherein said power supply comprises a D.C. power source in said receptacle means.

* * * * *